US010562674B2

(12) United States Patent
Kinouchi et al.

(10) Patent No.: US 10,562,674 B2
(45) Date of Patent: Feb. 18, 2020

(54) PLASTIC FORMED BODY FOR POURING OUT LIQUID

(71) Applicant: Toyo Seikan Co., Ltd., Tokyo (JP)

(72) Inventors: Kouki Kinouchi, Yokohama (JP); Teijirou Kanada, Yokohama (JP); Kenji Yoshihiro, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 0 days.

(21) Appl. No.: 15/118,562

(22) PCT Filed: Jan. 13, 2015

(86) PCT No.: PCT/JP2015/050585
§ 371 (c)(1),
(2) Date: Aug. 12, 2016

(87) PCT Pub. No.: WO2015/129303
PCT Pub. Date: Sep. 3, 2015

(65) Prior Publication Data

US 2017/0043911 A1 Feb. 16, 2017

(30) Foreign Application Priority Data

Feb. 27, 2014 (JP) ..... 2014-036361

(51) Int. Cl.
*B65D 25/40* (2006.01)
*B65D 25/42* (2006.01)
(Continued)

(52) U.S. Cl.
CPC ..... *B65D 25/42* (2013.01); *B65D 5/746* (2013.01); *B65D 47/06* (2013.01)

(58) Field of Classification Search
CPC .... B65D 47/06; B65D 47/0809; B65D 47/40; B65D 41/0421; B65D 25/42; B65D 5/746;
(Continued)

(56) References Cited

U.S. PATENT DOCUMENTS 3,354,022 A * 11/1967 Johnson, Jr. ..... B08B 17/02 264/284
3,868,051 A 2/1975 Goof
(Continued)

FOREIGN PATENT DOCUMENTS

CN 102963130 A 3/2013
CN 203158393 U 8/2013
(Continued)

OTHER PUBLICATIONS

Communication dated Aug. 31, 2017, from the European Patent Office in counterpart European application No. 15755505.3.
(Continued)

*Primary Examiner* — Charles Cheyney
(74) *Attorney, Agent, or Firm* — Sughrue Mion, PLLC

(57) ABSTRACT

A plastic formed body having a pouring port 110 for pouring out highly wetting liquid that wets plastics to a high degree, wherein at least either a surface 110*b* that becomes a liquid-drip flow passage when said liquid drips at the pouring port 110 or a surface 110*a* that becomes a flow passage when said liquid is poured out, is coated with a fluorine-contained resin, and a surface of the fluorine-contained resin coating has an arithmetic mean roughness (Ra) in a range of 0.4 to 200 μm in the surface roughness measurement and an element mean height (Rh) in a range of 0.04 to 10 as defined by mean height (Rc)/element mean length (RSm) in the linear roughness measurement. The
(Continued)

formed body effectively prevents said highly wetting liquid from dripping at the pouring port 110.

6 Claims, 6 Drawing Sheets

(51) Int. Cl.
*B65D 5/74* (2006.01)
*B65D 47/06* (2006.01)

(58) Field of Classification Search
CPC ..... B65D 47/2031; B65D 47/205; B05B 11/0016; B05B 11/0018; B05B 11/0021
USPC ..... 222/212, 207, 211, 213, 215, 494, 222/566–574
See application file for complete search history.

(56) References Cited

U.S. PATENT DOCUMENTS 4,222,504 A * 9/1980 Ackerman ..... B65D 23/065 222/569
4,347,875 A * 9/1982 Columbus ..... B01L 3/0275 141/18
5,509,585 A * 4/1996 Mock ..... B65D 5/746 215/341
6,247,603 B1 * 6/2001 Farrell ..... B65D 23/0814 215/12.2
8,372,496 B2 * 2/2013 Le Bris ..... A47J 36/02 220/573.2
8,574,704 B2 * 11/2013 Smith ..... B08B 17/065 428/143
8,940,361 B2 * 1/2015 Smith ..... B65D 23/02 427/180
9,862,525 B2 * 1/2018 Akutsu ..... B65D 47/40
10,131,804 B2 * 11/2018 Okada ..... B32B 17/06
10,159,385 B2 * 12/2018 Beckerman ..... A47K 5/122
10,221,321 B2 * 3/2019 Addleman ..... C09D 5/00
2003/0096083 A1 * 5/2003 Morgan ..... B05D 5/08 428/141
2010/0092621 A1 * 4/2010 Akutsu ..... B32B 27/18 426/106
2011/0077172 A1 * 3/2011 Aizenberg ..... B81C 1/00206 506/16
2013/0220813 A1 * 8/2013 Anand ..... B08B 17/065 204/471
2013/0235120 A1 9/2013 Hirabayashi et al.
2013/0251942 A1 * 9/2013 Azimi ..... C04B 35/50 428/141
2014/0332570 A1 11/2014 Akutsu et al.
2015/0083759 A1 * 3/2015 Medeiros ..... B65D 47/2018 222/494
2015/0108032 A1 4/2015 Akutsu et al.

FOREIGN PATENT DOCUMENTS

GB 1165675 A 10/1969
JP 1-279059 A 11/1989
JP 4-68826 U 6/1992
JP 2000-043873 A 2/2000
JP 3071296 U 8/2000
JP 3145715 U 10/2008
JP 2015-16597 A 1/2015
WO 2013/077380 A1 5/2013
WO 2014/010534 A1 1/2014

OTHER PUBLICATIONS

International Search Report of PCT/JP2015/050585 dated Mar. 24, 2015.
Communication dated Mar. 30, 2017 issued by the State Intellectual Property Office of People's Republic of China in counterpart application No. 201580010283.0.
Communication dated Sep. 18, 2017 from the State Intellectual Property Office of People's Republic of China in counterpart application No. 201580010283.0.

* cited by examiner

PLASTIC FORMED BODY FOR POURING OUT LIQUID

CROSS REFERENCE TO RELATED APPLICATIONS

This application is a National Stage of International Application No. PCT/JP2015/050585 filed Jan. 13, 2015, claiming priority based on Japanese Patent Application No. 2014-036361, filed Feb. 27, 2014, the contents of which are incorporated herein by reference in their entirety.

TECHNICAL FIELD

This invention relates to a plastic formed body for pouring out liquid, having a flow passage surface for flowing out such a liquid as oily liquid that highly wets the plastics.

BACKGROUND ART

Plastics are, generally, easier to form than glasses and metals, can be easily formed into a variety of shapes and have, therefore, been used in a variety of applications. Specifically, plastics are representatively used in a field of containers such as bottles and packings such as caps fitted to the containers.

Here, when a liquid is contained in the container, there inevitably arouses a problem of liquid dripping. Therefore, a contrivance is required such that, when the liquid contained in the container is to be poured out through a spout or a pouring nozzle of the cap, the liquid being poured out does not drip out creeping along an outer wall surface of a pouring port.

Various means have been proposed in an attempt to prevent the dripping of liquid. For instance, a patent document 1 is proposing a means of coating the pouring port with a fluorine-contained resin, and a patent document 2 is proposing a means of forming a rough surface in the pouring port.

PRIOR ART DOCUMENTS

Patent Documents

Patent document 1: Japanese Utility Model Registration No. 3071296

Patent document 2: Japanese Utility Model Laid-Open No. 4-68826

OUTLINE OF THE INVENTION

Problems that the Invention is to Solve

The conventional liquid drip-prevention means as proposed in the above prior arts are capable of dispelling aqueous liquid content to a sufficient degree and of effectively preventing the drip of liquid from the pouring port. However, these means are not still capable of preventing the drip of liquid to a sufficient degree specifically in the case of liquids that are prone to highly wet the plastic materials, such as edible oils, liquid detergents containing surfactants, and liquors containing alcohols at high concentrations. In particular, means of forming a rough surface in the pouring port rather causes the liquid to drip more.

It is, therefore, an object of the present invention to provide a plastic formed body having a pouring port for pouring out highly wetting liquid that wets plastics to a high degree, effectively preventing the highly wetting liquid from dripping at the pouring port.

Means for Solving the Problems

According to the present invention, there is provided a plastic formed body for pouring out liquid, having a pouring port for pouring out highly wetting liquid that wets plastics to a high degree, wherein:

at least either a surface that becomes a liquid-drip flow passage when said liquid drips at the pouring port or a surface that becomes a flow passage when said liquid is poured out, is coated with a fluorine-contained resin, and a surface of the fluorine-contained resin coating has an arithmetic mean roughness (Ra) in a range of 0.4 to 200 μm in the surface roughness measurement and an element mean height (Rh) in a range of 0.04 to 10 as defined by mean height (Rc)/element mean length (RSm) in the linear roughness measurement.

In the plastic formed body of the invention, it is desired that:

(1) An underlying surface coated with the fluorine-contained resin is a rough surface having the above arithmetic mean roughness (Ra) and the above element mean height (Rh), and the roughness is reflected on the surface of the fluorine-contained resin coating; and (2) Said highly wetting liquid forms a contact angle of not more than 40 degrees relative to a polyolefin resin.

In the plastic formed body of the invention, further, it is desired that:

(3) At least the surface of the pouring port is formed of a polyolefin resin;

(4) The plastic formed body is a spout that is fitted to a bag-like container or a paper container;

(5) The plastic formed body is a cap fitted to a mouth portion of a container, the cap having a pouring nozzle with the pouring port for pouring out said highly wetting liquid contained in the container; and (6) The plastic formed body is a bottle having the pouring port formed in a mouth portion of the bottle.

Effects of the Invention

The plastic formed body of the invention has a portion that becomes a pouring port for pouring out liquid that is contained in a container. The plastic formed body is, specifically, used for pouring out highly wetting liquid that wets plastics to a high degree. The pouring port is coated with a fluorine-contained resin, and a surface of the fluorine-contained resin coating is a rough surface having an arithmetic mean roughness (Ra) and an element mean height (Rh) that lie within predetermined ranges. That is, in the invention, the fluorine-contained resin coating improves repellency against the highly wetting liquid (i.e., forms an increased contact angle). Besides, as a result of the fact that the surface of the coating is the rough surface satisfying predetermined conditions, the surface exhibits very improved slipperiness for the liquid and, therefore, very improved liquid-dispelling property as also demonstrated in Examples appearing later. Therefore, the plastic formed body is capable of effectively preventing the drip of liquid at the time of pouring out liquid that wets plastics to a high degree, i.e., at the time of pouring out edible oils and the like liquids.

MODES FOR CARRYING OUT THE INVENTION

Figure 1:
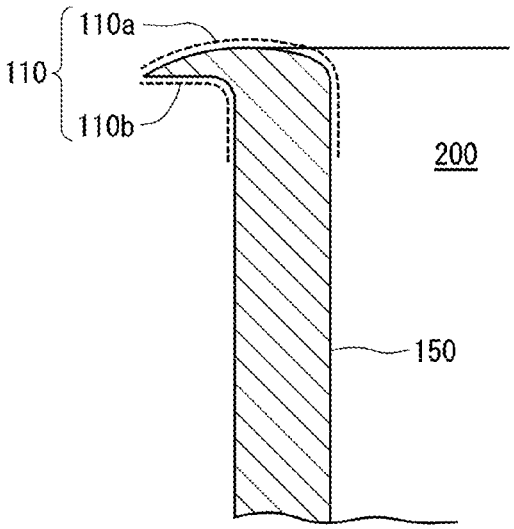
FIG. 1 is a half-sectional view schematically illustrating the shape of a pouring port that could cause liquid to drip.

Reference is now made to FIG. 1 which illustrates a pouring port that is a major portion of the plastic formed body of the invention. The plastic formed body has a pouring nozzle 150 with a pouring port 110 at an end thereof. The pouring nozzle 150 forms a liquid flow passage 200. Upon tilting the nozzle 150, a predetermined liquid is allowed to be poured out from the pouring port 110.

The pouring port 110 comprises a surface (upper surface) 110*a* that becomes a flow passage when the liquid is poured out and a surface (back surface) 110*b* that becomes a liquid-drip flow passage when the liquid drips.

The pouring port 110 may be formed straight. Usually, however, the pouring port 110 has a curved shape that extends outward maintaining an upwardly facing convex shape so that the liquid that is poured out will not flow down along the outer surface of the nozzle 150.

The plastic formed body of the invention having the pouring nozzle 150 may be formed by using a known plastic material that can be formed in any predetermined shape, and is formed by using a suitable thermoplastic resin depending on the use thereof. In the field of packing containers, for instance, the plastic formed body is formed by using, in many cases, a polyolefin resin such as polyethylene or polypropylene or by using a polyester resin such as polyethylene terephthalate (PET).

In the invention, the liquid poured out from the pouring nozzle 150 highly wets plastics and, concretely, forms a contact angle of not more than 40 degrees relative to the polyolefin resin (specifically, polypropylene). The contact angle is measured by dripping the liquid on a smooth surface (having an arithmetic mean roughness (Ra) of not more than 0.1 μm) of a polypropylene plate.

As the highly wetting liquid, as described above, there can be exemplified various kinds of edible oils, liquids containing surfactant, dressings, liquors containing alcohols at high concentrations, and the like.

In the pouring nozzle 150 for pouring out the highly wetting liquid, the pouring port 110 is coated with a fluorine-contained resin. Namely, at the time of pouring out the liquid by tilting the pouring nozzle 150, the liquid may drip. Here, with the fluorine-contained resin being applied onto the back surface 110*b* of the pouring port 110 that becomes the liquid-drip flow passage and onto the upper surface 110*a* that becomes the flow passage when the liquid is poured out, these surfaces exhibit improved repellency against the wetting liquid that is poured out.

As the fluorine-contained resin that is to be applied, there can be used any one that has been known per se. For example, there can be used polytetrafluoroethylene (PTFE), polychlorotrifluoroethylene (PCTFE), polyvinylidene fluoride (PVDF), polyvinyl fluoride (PVF), perfluoroalkoxy-fluorine-contained resin (PFA), ethylene tetrafluoride-propylene hexafluoride copolymer (FEP), ethylene-ethylene tetrafluoride copolymer (ETFE) and ethylene-chlorotrifluoroethylene copolymer (ECTFE), as well as commercially available fluorine resins, such as fluorine-contained resins of various kinds of grades like those of the Asahi Guard E-Series manufactured by ASAHI GLASS CO., LTD.

The fluorine-contained resin can be easily applied by preparing a coating solution by dissolving the resin in a suitable low-boiling organic solvent (e.g., hydrofluoroether, ethanol, etc.), and applying the coating solution onto the pouring port 110 followed by drying.

Further, the fluorine-contained resin is applied in a thickness of, usually, about 10 nm to about 1000 nm. The thickness that is too small tends to become uneven and may make it difficult to effectively impart liquid-repelling property. The thickness that is too large, on the other hand, makes it difficult to increase the effect of preventing the dripping any more causing the cost to rather increase and, besides, making it difficult to roughen the surface by a method that will be described later. That is, the rough surface formed in the mold is not reflected on the surface of the coating of the fluorine-contained resin.

To improve the adhesive strength between the fluorine-contained resin coating and the plastic material, further, there may be applied an acrylic resin or an acid-modified polyolefin resin as an underlying layer.

In the invention, it is necessary that the fluorine-contained resin coating has a rough surface.

Concretely speaking, it is necessary that the surface of the fluorine-contained resin coating has an arithmetic mean roughness (Ra) in a range of 0.4 to 200 μm, specifically, 0.4 to 150 μm in the surface roughness measurement and, further, has an element mean height (Rh) in a range of 0.04 to 10, specifically 0.04 to 8 as defined by mean height (Rc)/element mean length (RSm) in the linear roughness measurement. The roughness is measured in compliance with the JIS-B-0601-1994.

The arithmetic mean roughness (Ra) represents a mean absolute value of roughness in a region of a predetermined reference length while the element mean height (Rh) represents a mean height per a unit length of the element.

In the invention, coating the surface with the fluorine-contained resin and roughening the surface, help greatly improve the property for repelling the above-mentioned highly wetting liquid making it, therefore, possible to strikingly improve liquid-dispelling property and to effectively prevent the liquid from dripping.

Improving the liquid repellency by roughening the surface can be explained relying on the Cassie mode and the Wenzel mode.

Figure 2:
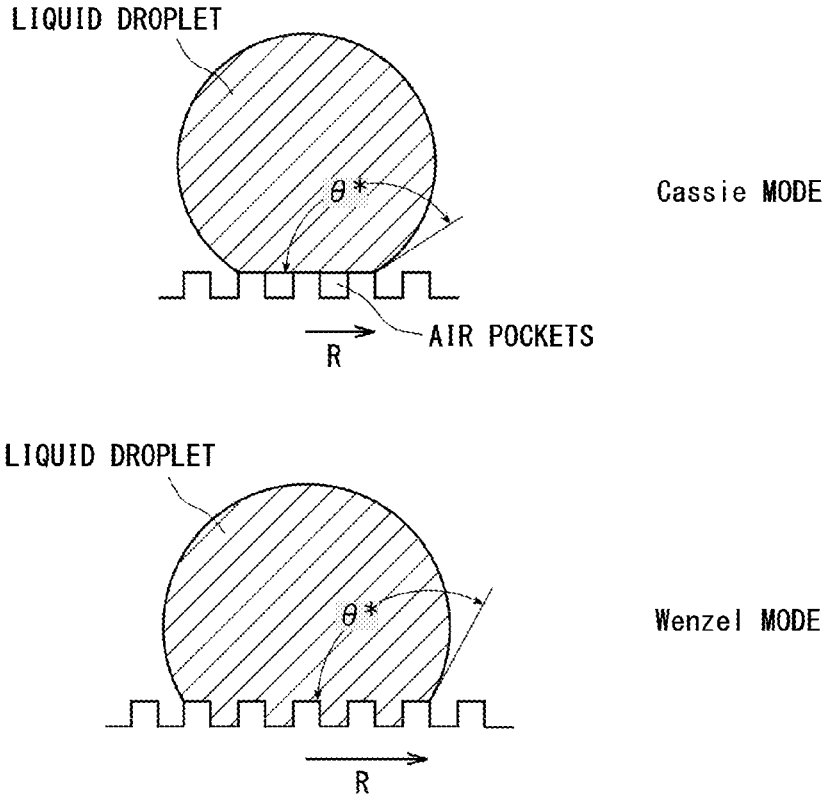
FIG. 2 is a view schematically illustrating contact patterns of a liquid droplet at a pouring port in the Cassie mode and the Wenzel mode.

FIG. 2 illustrates contact patterns of a liquid droplet on a rugged surface. In the Cassie mode in which the liquid droplet is placed on a rugged surface, air pockets are formed by the dents in the rugged surface, and the liquid droplet comes in composite contact with the solid and the gas (air). In the composite contact, the liquid comes in contact with the air that has the greatest liquid repellency and, therefore, a large liquid repellency is expressed. Namely, the liquid droplet has a small diameter R, the apparent angle θ* of contact is large, a large liquid repellency is produced, and the liquid is favorably prevented from dripping.

In the Wenzel mode, on the other hand, the liquid droplet is in contact with the whole surface. Therefore, the liquid droplet has a large diameter R and its apparent angle θ* of contact is smaller than that in the Cassie mode. Therefore, the liquid repellency is small, too. Besides, the liquid droplet tends to remain on the surface despite it has flown down. Namely, despite the surface has been roughened, the Wenzel mode is assumed if the roughness is fine. Therefore, a favorable liquid-dispelling property is not realized, and the liquid is not prevented from dripping to a sufficient degree.

According to the present invention as will be learned from the above description, the surface of the fluorine-contained resin coating is so roughened that the above-mentioned arithmetic mean roughness (Ra) and the element mean height (Rh) lie within predetermined ranges, enabling the liquid droplet to assume a contact pattern in the Cassie mode in which air pockets are made present and, therefore, making it possible to realize excellent liquid repellency aided by the above-mentioned coating of the fluorine-contained resin and to effectively prevent the liquid from dripping.

If, for example, the arithmetic mean roughness (Ra) or the element mean height (Rh) is smaller than the above ranges, then the Cassie mode is not realized, the liquid repellency becomes unsatisfactory, and the liquid is not prevented from dripping to a sufficient degree. The larger the arithmetic mean roughness (Ra) or the element mean height (Rh), the larger the liquid repellency and the higher the effect for preventing the drip of liquid. If they become larger than the above ranges, however, the pouring port 110 tends to have a decreased strength, a decreased scratch resistance and, further, tends to be easily broken or deformed.

After having been coated with the fluorine-contained resin, the surface can be roughened by the after-treatment such as stamping or blasting. However, such a treatment is cumbersome and causes a decrease in the productivity. In the present invention, therefore, it is desired that a portion corresponding to the pouring port 110 of the mold used for forming the plastic formed body is subjected to the roughening treatment such as blasting or etching so that the rough surface complies with the above-mentioned ranges. Then by using the mold, the plastic material is formed and is coated with the fluorine-contained resin thus forming the roughened surface. In this case, the underlying surface of the pouring port 110 coated with the fluorine-contained resin has already been roughened, and the rough surface is reflected on the surface of the fluorine-contained resin coating.

In the invention mentioned above, it is most desired that the fluorine-contained resin is applied and the surface is roughened both over the upper surface 110*a* and the back surface 110*b* of the pouring port 110. However, the fluorine-contained resin may be applied and the surface may be roughened over either the upper surface 110*a* (surface that becomes the flow passage when the liquid is poured out) or the back surface 110*b* (surface that becomes the liquid-drip flow passage when the liquid drips).

The regions where the fluorine-contained resin is applied and the surface is roughened are suitably set such that the liquid can be effectively prevented from dripping. On either the upper surface 110*a* or the back surface 110*b*, however, it is desired that the fluorine-contained resin is applied and the surface is roughened so as to cover at least the curved portions.

<Plastic Formed Body>

By utilizing excellent liquid repellency and liquid-dispelling property exhibited by the pouring port 110, the plastic formed body of the invention can be realized in a variety of forms. Namely, the plastic formed body exhibits not only very high slipping property to the liquids but also very favorable liquid-dispelling property, effectively preventing the liquid from dripping. Therefore, it can be effectively used as a packing body for containing oily liquids that exhibit high degree of wettability to the above-mentioned plastic materials.

The plastic formed body of the present invention may have the flow passage 200 through which the above highly wetting liquid flows and have the pouring port 110 for pouring out the liquid. For instance, it may assume the form of a container (e.g., bottle) with a mouth portion through which the liquid content is directly poured out. Usually, however, the plastic formed body of the invention, most desirably, is fitted to a container and is used for discharging the liquid contained therein, i.e., is used as a spout being fitted to a bag-like container or a paper container, or is used as a pouring cap being fitted to the mouth portion of the container such as bottle or the like from the standpoint of utilizing the advantage of the present invention to its maximum degree.

FIGS. 3 to 7 illustrate representative structures of the formed body that is used being fitted to the containers.

Figure 3:
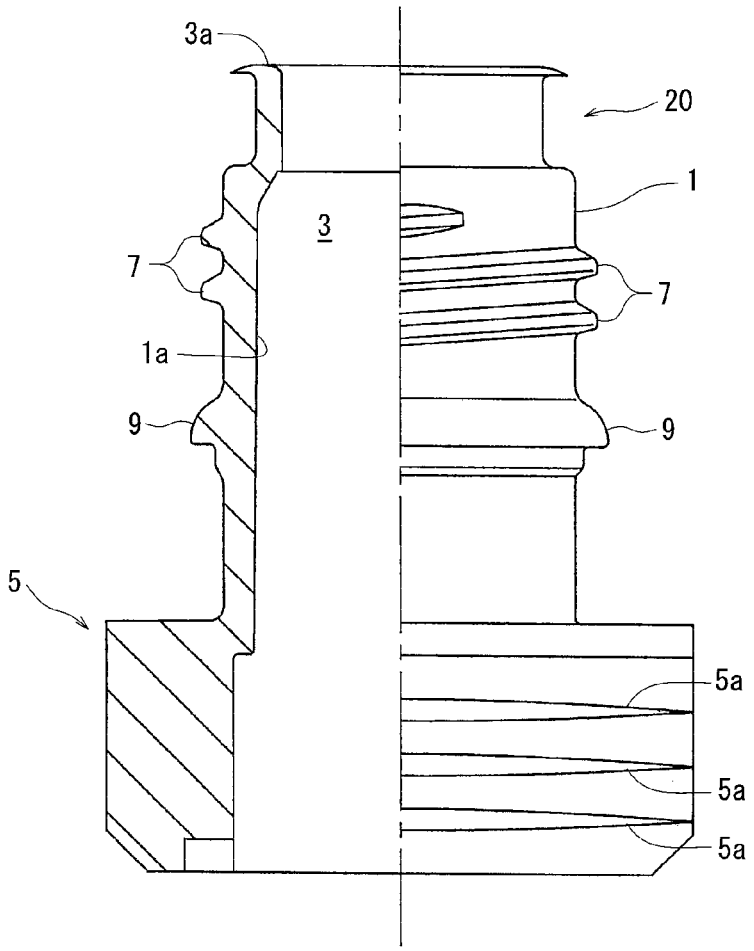
FIG. 3 is a half-sectional side view illustrating the structure of a spout which is an embodiment of the plastic formed body of the present invention.

FIG. 3 shows a spout fitted to a bag-like container. The spout (generally designated at 20) comprises a cylinder 1 of which the interior is a cavity. A flow passage 3 is formed by an inner surface 1*a* of the cylinder 1, and an upper end thereof serves as a pouring port 3*a* for discharging a fluid substance.

On a lower part on the outer surface of the cylinder 1, there is formed an expanded portion 5 on which a film will be melt-adhered to form a bag-like container. On the expanded portion 5, there are formed a plurality of ribs 5*a* (three ribs in FIG. 3) maintaining a gap in the up-and-down direction. The ribs 5*a* are evenly protruded maintaining a small height to ensure reliable melt-adhesion to the bag-like container (film) relying upon the heat-sealing.

Figure 4:
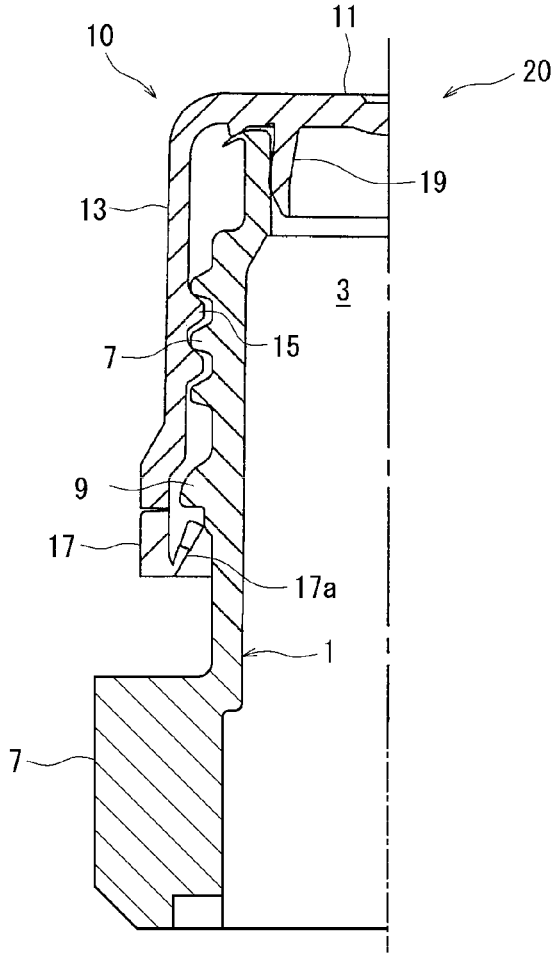
FIG. 4 is a half-sectional view illustrating the spout of FIG. 3 together with a lid body.

By also making reference to FIG. 4, on an upper part on the outer surface of the cylinder 1, there is formed a screw thread 7 for screw-fixing a lid body 10 that is fitted to the spout 20. On the lower side of the screw thread 7, there is formed a flange 9 protruding outward. The upper part of the screw thread 7 is formed in a small diameter so will not to hinder the attempt of screw-fitting the lid body 10 and, besides, so as to squeeze the width of the fluid substance that is poured out from the upper end.

Referring to FIG. 4, the lid body 10 is screw-fixed onto the spout 20 so as to cover the upper part of the cylinder 1. The lid body 10 comprises a top plate 11 and a skirt portion 13. On the outer surface of the skirt portion 13, there is formed a screw thread 15 that comes into screw-engagement with the screw thread 7 formed on the outer surface of the cylinder 1. At the lower end of the skirt portion 13, there is provided a tamper evidence band (TE band) 17 that has been known per se. On the other hand, a seal ring 19 is provided on the inner surface of the top plate 11.

With the lid body 10 being fitted due to the screw-engagement of the screw thread 7 with the screw thread and, further, with the upper end of the cylinder 1 being closed, the seal ring 19 is closely contacted to the inner surface 1*a* of the cylinder 1. Thus the flow passage is sealed, and the fluid substance is prevented from leaking to the exterior or foreign matter is prevented from entering into the container.

Further, in a state where the lid body 10 is fitted, the TE band 17 is positioned under the flange 9 on the outer surface of the cylinder 1. That is, the TE band 17 is continuous to the lower end of the skirt portion 13 via a breakable bridge portion. The TE band 17 is, further, forming protuberances 17*a* that are facing upward on the inner surface thereof. Therefore, if it is attempted to open the lid body 10 (disengage the screw-engagement) to remove it from the cylinder 1, the skirt portion 13 rises but the TE band 17 is prevented from rising due to the engagement of the protuberances 17*a* with the flange 9. As a result, the lid body 10 is removed while the TE band 17 is separated away from the skirt portion 13. With the TE band 17 being separated away, therefore, a general consumer is allowed to recognize the fact that the lid body 10 was opened. This makes it possible to prevent unauthorized use such as tampering and, therefore, to guarantee the quality of the content.

Figure 5:
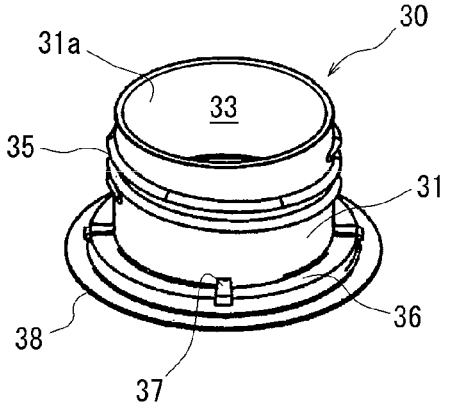
FIG. 5 is a perspective view illustrating the structure of a cap for a paper container, which is an embodiment of the plastic formed body of the present invention.

FIG. 5 shows the structure of a spout for a paper container.

The spout for the paper container generally designated at 30 has a considerably simple structure. Basically, however, the structure is the same as that of the spout for the bag-like containers.

The spout 30 is made of a cylinder 31 that forms the flow passage, and space in the cylinder 31 serves as a flow passage 33 being defined by an inner surface 31*a* of the cylinder 31. Therefore, an upper end of the cylinder 31 serves as the pouring port.

Figure 6:
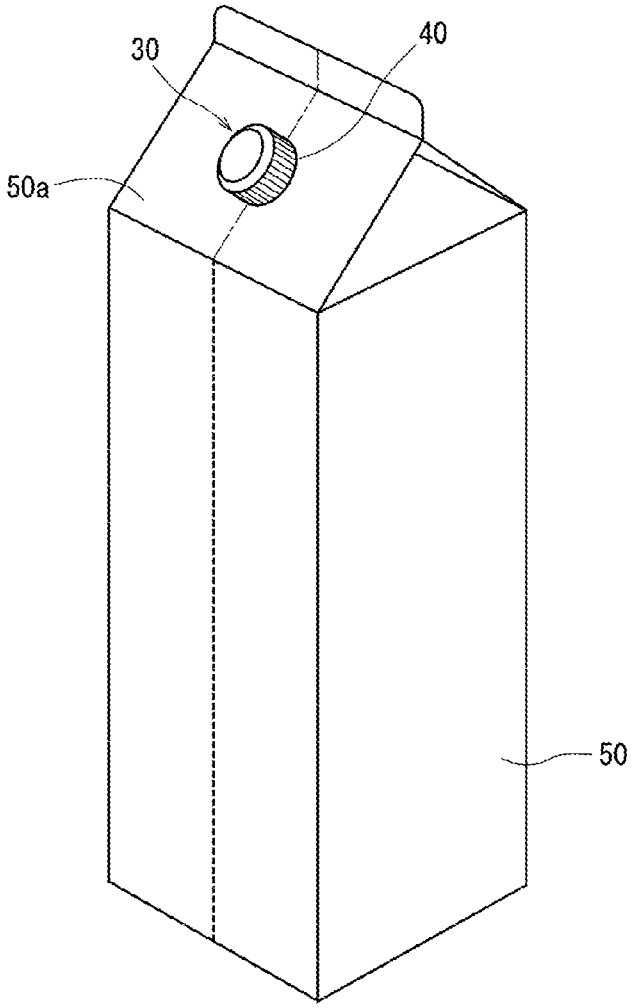
FIG. 6 is a view illustrating a state where the cap of FIG. 5 for a paper container is fitted to the paper container.

By making reference also to FIG. 6, on the outer surface of the cylinder 31, there is provided a screw thread 35 for fixing a lid body 40 by screw-engagement. Further, a thick seat 36 is formed at the lower end of the cylinder 31, the seat 36 forming a plurality of pawls 37 in the circumferential direction maintaining a gap. Further, an annular flange 38 is provided at the lower end thereof.

Namely, with this spout 30, the body 40 is screw-fixed to the cylinder 31. In this state, the lower part of the spout is inserted in the mouth portion of a paper sheet that forms the paper container shown in FIG. 6. In a state where the spout is false-fitted to the paper sheet relying upon the pawls 37, the paper sheet is fixed by being heat-sealed to the upper surface of the annular flange 38. Thus, as shown in FIG. 6, the spout 30 is fixed to a tilted portion 50*a* at the upper part of the paper container 50.

The paper container interrupts light to a high degree and is used for containing, specifically, a content that is subject to be easily degenerated by light.

Figure 7:
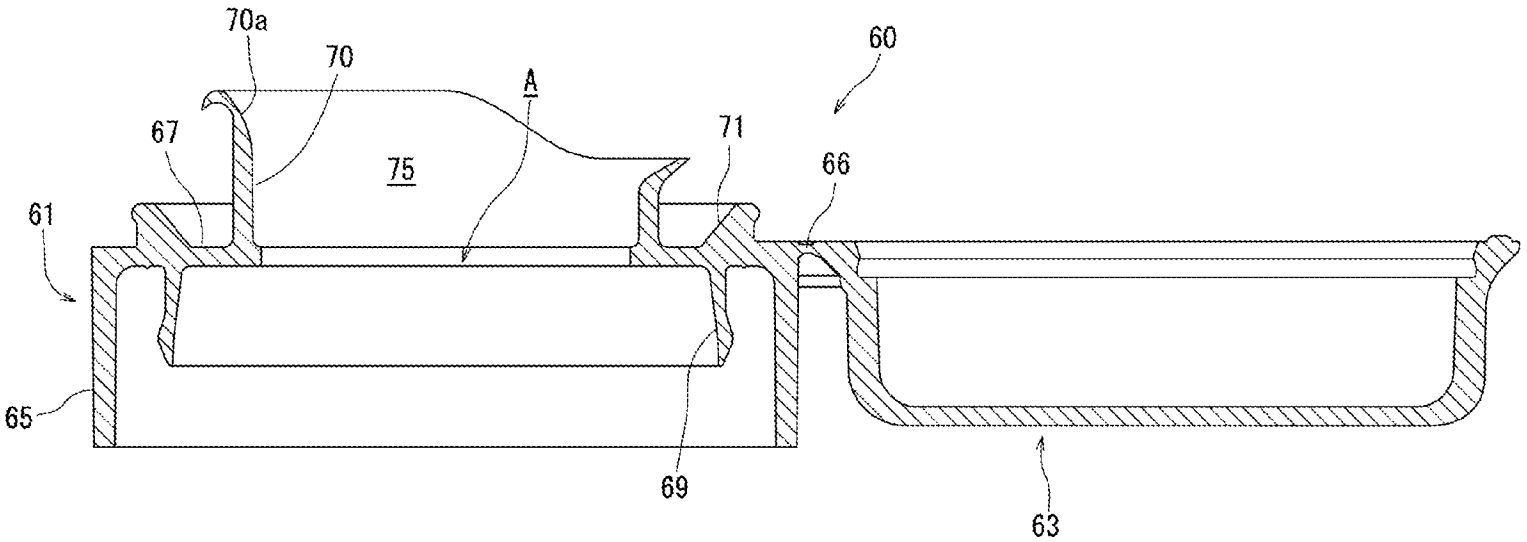
FIG. 7 is a sectional view illustrating the structure of a cap for pouring liquid, which is an embodiment of the plastic formed body of the present invention.

FIG. 7 shows the structure of the pouring cap fitted to the mouth portion of the container such as bottle or the like.

In FIG. 7, the cap (generally designated at 60) roughly comprises a cap body 61 and an upper lid 63.

The cap body 61 includes a cylindrical side wall 65 and a top wall 67 having an opening A in the central portion thereof.

The upper lid 63 is linked through a hinge band 66 to an upper end of the cylindrical side wall 65.

An inner ring 69 extends downward from the lower surface of the top wall 67 of the cap body 61 and maintains a small gap from the cylindrical side wall 65. Namely, the mouth portion of the container such as bottle is fitted and fixed in space between the cylindrical side wall 65 and the inner ring 69.

On the other hand, a pouring nozzle 70 is provided on the outer surface of the top wall 67 so as to surround the opening A, and an engaging protuberance 71 of a small height is formed on the outer side of the pouring nozzle 70.

That is, when the upper lid 63 is closed by being turned with the hinge band 66 as a fulcrum, the circumferential edge of the upper lid 63 comes into engagement with the engaging protuberance 71, and the upper lid 63 is closed and, in this state, is firmly fixed.

As will be understood from FIG. 7, further, the pouring nozzle 70 is formed to have a small height on the side of the upper lid 63. This is for a purpose that the pouring nozzle 70 does not become an obstacle when the upper lid 63 is to be turned and closed.

Further, though not shown in FIG. 7, a seal ring is, usually, provided on the inner surface of the upper lid 63 so that when the upper lid 63 is closed, the seal ring comes in close contact with the inner surface of the pouring nozzle 70 to maintain the sealing.

In the pouring cap 60 of the above-mentioned structure, a flow passage 75 is formed by the inner surface 70*a* (and the inner surface of the cylindrical side wall 65) of the pouring nozzle 70, and the liquid contained in the container such as bottle is discharged flowing through the flow passage 75.

In this state as will be understood from FIG. 7, therefore, the pouring port is formed by the upper end having a large height of the pouring nozzle 70 on the side opposite to the upper lid 63. The content is not discharged on the side of the upper lid 63 since the upper lid 63 would become an obstacle.

In the diagramed embodiment, the upper lid 63 is linked through the hinge. The upper lid 63, however, may be detachably provided by screw-engagement. In this case, a screw thread for screw-engagement is provided on the outer surface instead of providing the engaging protuberance 71. Further, at the time of discharging the content from the flow passage 75 formed in the pouring nozzle 70, the upper lid 63 will have been removed. Therefore, there is no need of partly decreasing the height of the pouring nozzle 70. Instead, the pouring port is formed by the whole circumference of the upper end of the pouring nozzle 70.

In the pouring fittings of the structures shown in FIGS. 3 to 7 as described above, the flow passages are illustrated in a state where the content to be discharged is allowed to flow. In a state where they have not yet been used, however, it is a general practice that the flow passages are closed by the shut-off walls having a score that can be torn away, the shut-off walls having a pull ring. In the pouring cap of FIG. 7, for example, the lower end of the pouring nozzle 70 is closed with the shut-off wall. A general consumer would purchase a container provided with the pouring fitting and would try to take out the content. In this case, the consumer, first, removes the shut-off wall by pulling the pull ring and opens the flow passage.

The above various kinds of plastic formed bodies inclusive of lid bodies thereof shown in FIGS. 3 to 7 can be formed by injection-forming or compression-forming various kinds of thermoplastic resins, particularly polyolefin resins, such as low-, medium- and high-density polyethylene, linear low-density polyethylene, isotactic polypropylene, syndiotactic polypropylene, poly(1-butene), poly(4-methyl-1-pentene), or random or block copolymers of α-olefins like ethylene, propylene, 1-butene, 4-methyl-1-pentene; polyester resins such as polyethylene terephthalate and the like; and, preferably, various kinds of polyethylenes, polypropylenes or polyethylene terephthalates.

The plastic formed body of the invention may, as a matter of course, possess a multilayered structure including a gas-barrier resin layer as an intermediate layer and, desirably, includes a portion made of a polyolefin resin on at least the surface of the pouring port.

EXAMPLES

Excellent properties of the invention will now be described below.

In the following Experimental Examples, various measurements and evaluations were taken by the methods described below.

Evaluating the Liquid-dispelling Property;

In a state where the containers (bottles) were erected, the sample caps prepared in Examples and Comparative Examples were so fitted that the pouring ports faced upward.

The state where the container was erected was regarded to be 0 degree. In case the container was tilted at an angle over a range of 70 to 75 degrees, the amount of the liquid content was so adjusted that the liquid content flew out while producing liquid droplets. At this angle, 20 liquid droplets were caused to flow out and thereafter the container was returned back to the state of 0 degree. This operation was repeated 5 times and if the liquid dripped was observed.

Measuring the Roughness;

A test sample was cut out from the pouring mouth portion of the sample cap, and on which gold was deposited in vacuum to a thickness that would not affect the roughness. The test sample was then measured for its roughness by using the "Laser Microscope VK-X100 for measuring the shape" manufactured by KEYENCE CORPORATION.

The lenses were a standard 50.0× and NA 0.800 lens, and measurement was taken maintaining a pitch of 0.13 μm.

As for the range of analysis, the surface roughness was measured for 276.8 μm×200.0 μm, the linear roughness was measured for 320.0 μm, and the cut-off values were λs=0.25 μm and λc=0.08 mm.

Measuring the Contact Angle;

A test sample was cut out from the pouring mouth portion of the sample cap, stored in an environment of 23° C. and 50% for 12 hours. Thereafter, by using a "Solid-Liquid Interface Analyzer, DropMaster 500" manufactured by Kyowa Interface Science Co., Ltd., a test solution maintained at 23° C. was dropped on the test sample in an amount of 1.0 μL from the tip of a syringe needle of 22 G (inner diameter of 0.4 mm). After 40 seconds have passed therefrom, the contact angle was measured.

The measurement was based on the sessile drop method and the analysis was based on the θ/2 method.

Evaluating the Appearance;

The pouring mouth portion of the sample cap was checked for its ruggedness with the eye.

Scratch Resistance;

The caps were packed in a box of a corrugated cardboard measuring 435×320×320 mm maintaining an inner height over a range of 290 mm to 310 mm, and on which vibration was exerted in a random fashion for 15 minutes in compliance with the packed cargo—performance testing method specified under the JIS-Z-0200. Thereafter, the caps were checked with the eye for any scratches.

There were used the following test liquids.

Water;

"Milli-Q water" produced by Millipore Corporation.

Edible Oil;

"Nisshin Canola Oil" produced by The Nisshin OilliO Group, Ltd.

(contact angle to polypropylene of 25 degrees)

Liquid Detergent;

"Attack NEO" produced by Kao Corporation.

(contact angle to polypropylene of 30 degrees)

80% Ethanol;

"Ethanol for precision analysis" manufactured by Wako Pure Chemical Industries, Ltd. was adjusted to 80 wt % with pure water ("Milli-Q water" produced by Millipore Corporation)

(contact angle to polypropylene of 20 degrees)

60% Ethanol;

"Ethanol for precision analysis" manufactured by Wako Pure Chemical Industries, Ltd. was adjusted to 60 wt % with pure water ("Milli-Q water" produced by Millipore Corporation)

(contact angle to polypropylene of 40 degrees)

Comparative Example 1

As the resin for forming, there was provided a polypropylene (Prime Polypro J226T manufactured by Prime Polymer Co., Ltd., MFR=20 g/10 min.).

By using an injection mold, the above polypropylene was injection-formed into a cap of a shape shown in FIG. 7 (but having no hinged cap, and the pouring nozzle having a uniform height).

The pouring port of the thus obtained cap was evaluated for its liquid-dispelling property, roughness, contact angle, appearance and scratch resistance. The results were as shown in Table 1.

Comparative Example 2

As the resin for forming, there was provided a blend of a polypropylene (WELNEX RFX4 manufactured by Japan Polypropylene Corporation, MFR=6 g/10 min.) and a polyethylene (Kernel KS560T manufactured by Japan Polyethylene Corporation, MFR=16.5 g/10 min.) at a weight ratio of 80:20.

The mold was blast-treated (with the HN20 manufactured by Nihon Etching Co., Ltd.) at portions corresponding to the portion (upper surface 110*a*) that becomes the flow passage when the liquid content is poured from the pouring port and the portion (back surface 110*b*) that becomes the flow passage when the liquid drips. The above resin for forming was injection-formed in the same manner as in Comparative Example 1 but using the above mold. The pouring port of the thus obtained cap was evaluated for its properties. The results were as shown in Table 1.

Comparative Example 3

A coating solution of a fluorine-contained resin was prepared by dissolving 1 wt % of a fluorine-contained resin (AsahiGuard E-Series AG-E060 manufactured by ASAHI GLASS CO., LTD.) in 99 wt % of ethanol (ethanol for precision analysis manufactured by Wako Pure Chemical Industries, Ltd.).

The pouring port (upper surface 110*a* and back surface 110*b*) of the cap obtained in Comparative Example 1 was dipped in the above coating solution, and was dried in an environment of 23° C. and RH50% for 3 hours so as to be coated with the fluorine-contained resin.

The pouring port of the cap was evaluated for its properties in the same manner as in Comparative Example 1. The results were as shown in Table 1.

Comparative Example 4

A cap having the pouring port coated with the fluorine-contained resin was obtained in the same manner as in Comparative Example 3 but subjecting the mold to the blast treatment (with the HN23 manufactured by Nihon Etching Co., Ltd.) and to the gloss treatment at portions corresponding to the portion (upper surface 110*a*) that becomes the flow passage when the liquid content is poured from the pouring port and the portion (back surface 110*b*) that becomes the flow passage when the liquid drips. The pouring port of the thus obtained cap was evaluated for its properties. The results were as shown in Table 1.

Comparative Example 5

A cap having the pouring port coated with the fluorine-contained resin was obtained in the same manner as in Comparative Example 3 but subjecting the mold to the blast treatment (with the HM-DS02 manufactured by Nihon Etching Co., Ltd.) at portions corresponding to the portion (upper surface 110*a*) that becomes the flow passage when the liquid content is poured from the pouring port and the portion (back surface 110*b*) that becomes the flow passage when the liquid drips. The pouring port of the thus obtained cap was evaluated for its properties. The results were as shown in Table 1.

Comparative Example 6

As the resin for forming, there was provided a polypropylene (WELNEX RMG02VC manufactured by Japan Polypropylene Corporation, MFR=20 g/10 min.).

The mold was machined at portions corresponding to the upper surface 110*a* and the back surface 110*b* to form a rough surface having an arithmetic mean roughness Ra of 300.0 μm and an element mean height Rh (Rc/RSm) of 12.0.

A cap having the pouring port coated with the fluorine-contained resin was obtained in the same manner as in Comparative Example 3 but injection-forming the above resin by using the above mold. The pouring port of the thus obtained cap was evaluated for its properties. The results were as shown in Table 1.

Example 1

A cap having the pouring port coated with the fluorine-contained resin was obtained in the same manner as in Comparative Example 3 but subjecting the mold to the blast treatment (with the Honing No 3 manufactured by Nihon Etching Co., Ltd.) at portions corresponding to the portion (upper surface 110*a*) that becomes the flow passage when the liquid content is poured from the pouring port and the portion (back surface 110*b*) that becomes the flow passage when the liquid drips. The pouring port of the thus obtained cap was evaluated for its properties. The results were as shown in Table 1.

Example 2

A cap having the pouring port coated with the fluorine-contained resin was obtained in the same manner as in Comparative Example 3 but subjecting the mold to the blast treatment (with the Honing No 7 manufactured by Nihon Etching Co., Ltd.) at portions corresponding to the portion (upper surface 110*a*) that becomes the flow passage when the liquid content is poured from the pouring port and the portion (back surface 110*b*) that becomes the flow passage when the liquid drips. The pouring port of the thus obtained cap was evaluated for its properties. The results were as shown in Table 1.

Example 3

A cap having the pouring port coated with the fluorine-contained resin was obtained in the same manner as in Comparative Example 3 but subjecting the mold to the blast treatment (with the Honing No 9 manufactured by Nihon Etching Co., Ltd.) at portions corresponding to the portion (upper surface 110*a*) that becomes the flow passage when the liquid content is poured from the pouring port and the portion (back surface 110*b*) that becomes the flow passage when the liquid drips. The pouring port of the thus obtained cap was evaluated for its properties. The results were as shown in Table 1.

Example 4

A cap having the pouring port coated with the fluorine-contained resin was obtained in the same manner as in Comparative Example 3 but subjecting the mold to the blast treatment (with the Satin No 1 manufactured by Nihon Etching Co., Ltd.) and to the gloss treatment at portions corresponding to the portion (upper surface 110*a*) that becomes the flow passage when the liquid content is poured from the pouring port and the portion (back surface 110*b*) that becomes the flow passage when the liquid drips. The pouring port of the thus obtained cap was evaluated for its properties. The results were as shown in Table 1.

Example 5

As the resin for forming, there was provided a polypropylene (WELNEX RMG02VC manufactured by Japan Polypropylene Corporation, MFR=20 g/10 min.).

A cap having the pouring port coated with the fluorine-contained resin was obtained in the same manner as in Example 1 but using the above resin for forming. The pouring port of the thus obtained cap was evaluated for its properties. The results were as shown in Table 1.

Example 6

As the resin for forming, there was provided a polypropylene (WELNEX RMG02VC manufactured by Japan Polypropylene Corporation, MFR=20 g/10 min.).

A cap having the pouring port coated with the fluorine-contained resin was obtained in the same manner as in Example 2 but using the above resin for forming. The pouring port of the thus obtained cap was evaluated for its properties. The results were as shown in Table 1.

Example 7

As the resin for forming, there was provided a polypropylene (WELNEX RMG02VC manufactured by Japan Polypropylene Corporation, MFR=20 g/10 min.).

A cap having the pouring port coated with the fluorine-contained resin was obtained in the same manner as in Example 3 but using the above resin for forming. The pouring port of the thus obtained cap was evaluated for its properties. The results were as shown in Table 1.

Example 8

As the resin for forming, there was provided a polypropylene (WELNEX RMG02VC manufactured by Japan Polypropylene Corporation, MFR=20 g/10 min.).

The mold was subjected to the blast treatment (with the HN20 manufactured by Nihon Etching Co., Ltd.) at portions corresponding to the portion (upper surface 110*a*) that becomes the flow passage when the liquid content is poured from the pouring port and the portion (back surface 110*b*) that becomes the flow passage when the liquid drips.

A cap having the pouring port coated with the fluorine-contained resin was obtained in the same manner as in Comparative Example 3 but injection-forming the above resin by using the above mold. The pouring port of the thus obtained cap was evaluated for its properties. The results were as shown in Table 1.

Example 9

A cap having the pouring port coated with the fluorine-contained resin was obtained in the same manner as in Example 8 but subjecting the mold to the blast treatment (with the HN23 manufactured by Nihon Etching Co., Ltd.)

at portions corresponding to the portion (upper surface 110*a*) that becomes the flow passage when the liquid content is poured from the pouring port and the portion (back surface 110*b*) that becomes the flow passage when the liquid drips. The pouring port of the thus obtained cap was evaluated for its properties. The results were as shown in Table 1.

Example 10

A cap having the pouring port coated with the fluorine-contained resin was obtained in the same manner as in Example 8 but subjecting the mold to the blast treatment (with the HN26 manufactured by Nihon Etching Co., Ltd.) at portions corresponding to the portion (upper surface 110*a*) that becomes the flow passage when the liquid content is poured from the pouring port and the portion (back surface 110*b*) that becomes the flow passage when the liquid drips. The pouring port of the thus obtained cap was evaluated for its properties. The results were as shown in Table 1.

Example 11

As the resin for forming, there was provided a polyethylene (Kernel KS571 manufactured by Japan Polyethylene Corporation, MFR=20 g/10 min.).

A cap having the pouring port coated with the fluorine-contained resin was obtained in the same manner as in Example 8 but using the above resin for forming. The pouring port of the thus obtained cap was evaluated for its properties. The results were as shown in Table 1.

Example 12

As the resin for forming, there was provided a blend of a polypropylene (WELNEX RFX4 manufactured by Japan Polypropylene Corporation, MFR=6 g/10 min.) and a polyethylene (Kernel KS560T manufactured by Japan Polyethylene Corporation, MFR=16.5 g/10 min,) at a weight ratio of 80:20.

A cap having the pouring port coated with the fluorine-contained resin was obtained in the same manner as in Example 8 but using the above resin for forming. The pouring port of the thus obtained cap was evaluated for its properties. The results were as shown in Table 1.

Example 13

As the resin for forming, there was provided a polypropylene (WELNEX RMG02VC manufactured by Japan Polypropylene Corporation, MFR=20 g/10 min.).

The mold was machined at portions corresponding to the portion (upper surface 110*a*) that becomes the flow passage when the liquid content is poured from the pouring port and the portion (back surface 110*b*) that becomes the flow passage when the liquid drips to form a rough surface having an arithmetic mean roughness Ra of 11.0 μm and an element mean height Rh (Rc/RSm) of 1.05.

A cap having the pouring port coated with the fluorine-contained resin was obtained in the same manner as in Comparative Example 3 but injection-forming the above resin by using the above mold. The pouring port of the thus obtained cap was evaluated for its properties. The results were as shown in Table 1.

Example 14

The mold was machined at portions corresponding to the portion (upper surface 110*a*) that becomes the flow passage when the liquid content is poured from the pouring port and the portion (back surface 110*b*) that becomes the flow passage when the liquid drips to form a rough surface having an arithmetic mean roughness Ra of 120.0 μm and an element mean height Rh (Rc/RSm) of 1.15.

A cap having the pouring port coated with the fluorine-contained resin was obtained in the same manner as in Example 13 but effecting the injection-forming by using the above mold. The pouring port of the thus obtained cap was evaluated for its properties. The results were as shown in Table 1.

Example 15

The mold was machined at portions corresponding to the portion (upper surface 110*a*) that becomes the flow passage when the liquid content is poured from the pouring port and the portion (back surface 110*b*) that becomes the flow passage when the liquid drips to form a rough surface having an arithmetic mean roughness Ra of 220.0 μm and an element mean height Rh (Rc/RSm) of 1.22.

A cap having the pouring port coated with the fluorine-contained resin was obtained in the same manner as in Example 13 but effecting the injection-forming by using the above mold. The pouring port of the thus obtained cap was evaluated for its properties. The results were as shown in Table 1.

Example 16

The mold was machined at portions corresponding to the portion (upper surface 110*a*) that becomes the flow passage when the liquid content is poured from the pouring port and the portion (back surface 110*b*) that becomes the flow passage when the liquid drips to form a rough surface having an arithmetic mean roughness Ra of 11.0 μm and an element mean height Rh (Rc/RSm) of 4.7.

A cap having the pouring port coated with the fluorine-contained resin was obtained in the same manner as in Example 13 but effecting the injection-forming by using the above mold. The pouring port of the thus obtained cap was evaluated for its properties. The results were as shown in Table 1.

Example 17

The mold was machined at portions corresponding to the portion (upper surface 110*a*) that becomes the flow passage when the liquid content is poured from the pouring port and the portion (back surface 110*b*) that becomes the flow passage when the liquid drips to form a rough surface having an arithmetic mean roughness Ra of 11.0 μm and an element mean height Rh (Rc/RSm) of 8.9.

A cap having the pouring port coated with the fluorine-contained resin was obtained in the same manner as in Example 13 but effecting the injection-forming by using the above mold. The pouring port of the thus obtained cap was evaluated for its properties. The results were as shown in Table 1.

TABLE 1

| | Surface coating | Ra | Rc/RSm | Contact angle to edible oil |
|---|---|---|---|---|
| Comp. Ex. 1 | none | 0.0 μm | — | 25° |
| Comp. Ex. 2 | none | 2.4 μm | 0.19 | 20° |
| Comp. Ex. 3 | F-contained resin | 0.0 μm | — | 75° |
| Comp. Ex. 4 | F-contained resin | 1.2 μm | 0.02 | 82° |
| Comp. Ex. 5 | F-contained resin | 1.2 μm | 0.03 | 82° |
| Comp. Ex. 6 | F-contained resin | 220.0 μm | 11.00 | 124° |
| Example 1 | F-contained resin | 0.4 μm | 0.05 | 900 |
| Example 2 | F-contained resin | 1.1 μm | 0.10 | 88° |
| Example 3 | F-contained resin | 1.5 μm | 0.10 | 88° |
| Example 4 | F-contained resin | 0.7 μm | 0.04 | 85° |
| Example 5 | F-contained resin | 0.9 μm | 0.13 | 100° |
| Example 6 | F-contained resin | 1.9 μm | 0.21 | 101° |
| Example 7 | F-contained resin | 2.4 μm | 0.20 | 105° |
| Example 8 | F-contained resin | 2.6 μm | 0.23 | 110° |
| Example 9 | F-contained resin | 3.3 μm | 0.22 | 110° |
| Example 10 | F-contained resin | 4.0 μm | 0.21 | 108° |
| Example 11 | F-contained resin | 1.8 μm | 0.11 | 92° |
| Example 12 | F-contained resin | 2.4 μm | 0.19 | 100° |
| Example 13 | F-contained resin | 10.0 μm | 1.00 | 117° |
| Example 14 | F-contained resin | 100.0 μm | 1.00 | 119° |
| Example 15 | F-contained resin | 150.0 μm | 1.00 | 120° |
| Example 16 | F-contained resin | 10.0 μm | 4.00 | 121° |
| Example 17 | F-contained resin | 10.0 μm | 8.00 | 122° |

| | Liquid dripped | | | | | | |
|---|---|---|---|---|---|---|---|
| | Water | Edible oil | Liquid detergent | 80% Ethanol | 60% Ethanol | Appearance | Scratch resistance |
| Comp. Ex. 1 | no | yes | yes | yes | yes | good | good |
| Comp. Ex. 2 | no | yes | yes | yes | yes | good | good |
| Comp. Ex. 3 | no | yes | yes | yes | yes | good | good |
| Comp. Ex. 4 | no | yes | yes | yes | yes | good | good |
| Comp. Ex. 5 | no | yes | yes | yes | yes | good | good |
| Comp. Ex. 6 | no | no | no | no | no | poor | poor |
| Example 1 | no | no | no | no | no | good | good |
| Example 2 | no | no | no | no | no | good | good |
| Example 3 | no | no | no | no | no | good | good |
| Example 4 | no | no | no | no | no | good | good |
| Example 5 | no | no | no | no | no | good | good |
| Example 6 | no | no | no | no | no | good | good |
| Example 7 | no | no | no | no | no | good | good |
| Example 8 | no | no | no | no | no | good | good |
| Example 9 | no | no | no | no | no | good | good |
| Example 10 | no | no | no | no | no | good | good |
| Example 11 | no | no | no | no | no | good | good |
| Example 12 | no | no | no | no | no | good | good |
| Example 13 | no | no | no | no | no | good | good |
| Example 14 | no | no | no | no | no | good | good |
| Example 15 | no | no | no | no | no | good | good |
| Example 16 | no | no | no | no | no | good | good |
| Example 17 | no | no | no | no | no | good | good |

DESCRIPTION OF REFERENCE NUMERALS

110: pouring port
110*a*: portion that becomes the flow passage when the liquid content is poured from the pouring port
110*b*: portion (back surface) that becomes the flow passage when the liquid drips
150: pouring nozzle
200: flow passage

The invention claimed is:

1. A plastic formed spout for pouring out liquid, the spout having an upper end pouring port for pouring out highly wetting liquid that wets plastics to a high degree, wherein:

a. the spout includes a cylinder leading to the pouring port that becomes a flow passage when liquid is poured out;

b. the pouring port has an upper surface with a curved shape that extends outward maintaining an upwardly facing convex shape for liquid to pass over, and a pouring port back surface disposed under the upper surface forming a liquid-drip flow passage on an exterior of the cylinder when said liquid drips at the pouring port, the upper surface and the back surface are coated with a solidified coating of a fluorine-contained resin;

c. the back surface and the upper surface define the underlying surfaces of the coating; the underlying surfaces are rough surfaces having an arithmetic mean roughness (Ra) in a range of 0.4 to 200 μm and an element mean height (Rh) in a range of 0.04 to 10 as defined by mean height (Rc)/element mean length (RSm) in the linear roughness measurement, and d. the fluorine-contained resin coating has an outer surface having the same arithmetic mean roughness (Ra) and the same element mean height (Rh) as the underlying surfaces due to the fluorine-contained resin being coated thereon.

2. The plastic formed spout for pouring out liquid according to claim 1, wherein said highly wetting liquid forms a contact angle of not more than 40 degrees relative to a polyolefin resin.

3. The plastic formed spout for pouring out liquid according to claim 1, wherein at least the surface of the pouring port is formed of a polyolefin resin.

4. The plastic formed spout for pouring out liquid according to claim 1, wherein the plastic formed spout is fitted to a bag-like container or a paper container.

5. The plastic formed spout for pouring out liquid according to claim 1, wherein the spout is a cap fitted to a mouth portion of a container, the cap having a pouring nozzle with the pouring port for pouring out said highly wetting liquid contained in the container.

6. A bottle including the plastic formed spout according to claim 1, wherein the pouring port is formed in a mouth portion of the bottle.

* * * * *